US008222186B2

(12) United States Patent
Majumdar et al.

(10) Patent No.: US 8,222,186 B2
(45) Date of Patent: Jul. 17, 2012

(54) THERMAL DYE IMAGE RECEIVER ELEMENTS

(75) Inventors: Debasis Majumdar, Rochester, NY (US); James S. Honan, Spencerport, NY (US); Charles H. Weidner, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 470 days.

(21) Appl. No.: 12/581,921

(22) Filed: Oct. 20, 2009

(65) Prior Publication Data

US 2011/0091667 A1 Apr. 21, 2011

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS

| | | | |
|---|---|---|---|
| 5,302,574 | A | 4/1994 | Lawrence et al. |
| 5,384,304 | A | 1/1995 | Kung et al. |
| 5,646,090 | A | 7/1997 | Tamura et al. |
| 5,710,096 | A | 1/1998 | Ohnishi et al. |
| 5,718,995 | A | 2/1998 | Eichorst et al. |
| 5,719,016 | A | 2/1998 | Christian et al. |
| 6,124,083 | A | 9/2000 | Majumdar et al. |
| 6,335,102 | B1 | 1/2002 | Tsubaki et al. |
| 6,429,248 | B2 | 8/2002 | Schwark et al. |
| 6,893,592 | B2 | 5/2005 | Arrington et al. |
| 6,897,183 | B2 | 5/2005 | Arrington et al. |
| 2008/0220190 | A1 | 9/2008 | Majumdar et al. |

*Primary Examiner* — Bruce H Hess
(74) *Attorney, Agent, or Firm* — J. Lanny Tucker

(57) ABSTRACT

A thermal dye image receiver element has, in order, a cellulosic raw base support, an antistatic subbing layer, and a thermal dye receiving layer. The cellulosic raw base support has an internal electrical resistance (WER) that is at least 1 log ohm/square greater than the surface electrical resistance (SER) of the antistatic subbing layer. This arrangement of antistatic properties overcomes a static problem in the thermal dye image receiver elements by properly balancing the conductivity between the two antistatic locations.

18 Claims, No Drawings

THERMAL DYE IMAGE RECEIVER ELEMENTS

FIELD OF THE INVENTION

This invention relates to thermal dye image receiver elements that have improved antistatic properties and that can be used in combination with dye donor elements to provide color images using thermal transfer. This invention also relates to assemblies including both a thermal dye image receiver element and a dye donor element.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye-donor element is placed face-to-face with a dye receiver element in an image assembly. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other colors. A color hard copy is thus obtained which corresponds to the original picture viewed on a screen.

Thermal dye receiver elements used in thermal dye transfer generally include a support (transparent or reflective) bearing on one side thereof a dye image-receiving layer, and optionally additional layers, such as a compliant or cushioning layer between the support and the dye receiving layer.

The problem of controlling static charge is well known in the imaging industry. The accumulation of charge on film or paper surfaces leads to the attraction of dirt that can produce physical defects. It can also lead to transport issues during manufacturing, finishing and printing. The discharge of accumulated charge during manufacturing and finishing poses fire and safety hazards. The static problems have been aggravated by an increase in speed of manufacturing as well as printing.

In thermal transfer systems, a particularly unique source of charge generation is the dye transfer process itself wherein dissimilar materials are brought in close contact, followed by mass transfer (dyes and protective overcoat from donor to the receiver), further followed by rapid separation of the receiver and donor. The post-printing charge created in this manner is particularly undesirable for the receiver, since it can cause print-sticking, making it difficult for the user to subsequently handle prints, that is shuffle and stack prints, sort orders, separate prints, and other handling operations. For thermal dye receiver elements with a reflective support, typically comprising cellulosic paper, the post-printing charge created at the surface can induce "image charge" inside the paper (which is normally conductive) creating an electric field internal to the support that strongly holds the surface charge. This type of charge known as "polar" charge is very difficult to dissipate and can be a significant contributor to print-sticking problems.

Antistatic materials for imaging elements including thermal dye image receiver elements are known in the art, and include a broad variety of ionic and electronic conductive materials as well as charge dissipating surfactants.

U.S. Pat. No. 6,124,083 (Majumdar et al.) describes the use of sulfonated polyurethane film-forming binders and electronically-conductive polymers in various imaging elements including thermal imaging elements.

U.S. Pat. No. 5,710,096 (Ohnishi et al.) describes the use of an intermediate conductive layer in thermal transfer image-receiving sheets. These intermediate layers can include various conductive resins.

U.S. Pat. No. 5,384,304 (Kung et al.) describes the use of ionic conductors in a subbing layer under a solvent coated dye receiver layer for thermal receiver elements.

U.S. Patent Application Publication 2008/0220190 (Majumdar et al.) describes the use of aqueous subbing layers in extruded thermal dye receiver elements.

In general, electronic conductors have been found to be most effective in static dissipation but with higher cost. Ionic conductors, though inexpensive, show humidity dependent performance and may not be as effective in very dry conditions.

There remains a need to improve the conductive properties of the thermal dye image receiver elements so that static is properly and completely dissipated in a practical cost-effective way.

SUMMARY OF THE INVENTION

This invention provides a thermal dye image receiver element comprising, in order:

a cellulosic raw base support, an antistatic subbing layer, and a thermal dye receiving layer, wherein the cellulosic raw base support has an internal electrical resistance (also known as water electrode resistance or WER) that is at least 1 log ohm/square greater than the surface electrical resistance (SER) of the antistatic subbing layer.

This invention also provides an assembly comprising the thermal dye image receiver element of this invention and a thermal dye donor element.

In some embodiments, in this assembly, the internal electrical resistance (or WER) of the cellulosic raw base support is at least 1.5 log ohm/square greater than the surface electrical resistance (or SER) of the antistatic subbing layer, the antistatic subbing layer comprises an electronically conductive material such as tin oxide in an amount of from about 1 to about 70 weight % based on dry subbing layer weight, and the cellulosic raw base support comprises an electrolyte of up to 0.5 weight % based on total dry base support weight.

The present invention provides a solution to the static problem thermal dye image receiver elements by properly balancing the conductivity (electrical resistance) in both an antistatic subbing layer and the cellulose raw base support. More specifically, the cellulosic raw base support has an internal electrical resistance (WER) that is at least 1 log ohm/square (or at least 1.5 log ohm/square) greater than the surface electrical resistance (SER) of the antistatic subbing layer.

DETAILED DESCRIPTION OF THE INVENTION

Definitions

Unless otherwise indicated, the terms "thermal dye transfer receiver element", "thermal receiver element", and "receiver element" refer to embodiments of the present invention.

The thermal dye image receiver element has one or more layers on a suitable cellulosic raw base substrate, at least one layer being an antistatic layer that is optionally an aqueous-coated layer. Other useful layers are described below.

The thermal dye transfer receiver elements do not contain silver halide or silver halide emulsions as are common in photographic or photothermographic elements.

The terms as used herein, "top", "upper", and "face" mean the side or toward the side of the imaging member bearing the imaging layers, image, or receiving the image.

The terms "bottom", "lower side", and "back" mean the side or toward the side of the imaging member opposite from the side bearing the imaging layers, image, or receiving the image.

The term "non-voided" as used to refer to a layer being devoid of added solid or liquid matter or voids containing a gas.

The term "voided" will include materials comprising microvoided polymers and microporous materials known in the art.

By "aqueous", we mean that a layer is coated from a coating composition wherein the coating medium is substantially water. Any organic solvents in such coating compositions are typically present at less than 50% by weight.

The thermal dye image transfer element can include a "dye receiving layer" (DRL).

WER internal electrical resistance refers to a measurement of a conductive layer that is underneath one or more other layers that are insulating and can be determined following the procedure described in R. A. Elder, "Resistivity Measurements on Buried Conductive Layers", EOS/ESD Symposium Proceedings, September 1990, pages 251-254. Thus, the WER internal electrical resistance (log ohm/square) of the cellulosic raw base support used in this invention is measured between polypropylene films as described below for the Examples.

SER surface electrical resistance refers to a measurement of the surface of a conductive layer over an insulating layer. For example, the SER value (log ohm/square) for the antistatic subbing layer used in this invention is measured with the layer arranged over an insulating voided polypropylene film. This measurement can be determined using a Trek Surface Resistance meter Model 152P-CR as described below for the Examples.

Thermal Dye Receiving Layer

The thermal dye image-receiving layer (DRL) can be formed on the aqueous-coated antistatic subbing layer, for example using thermal extrusion, solvent coating, or aqueous-based coating formulations. The thermal dye image-receiving layer can comprise a polymeric material chosen for its compatibility and receptivity for the dyes to be transferred from a dye-donor element. During thermal printing, a dye can migrate rapidly from a dye-donor layer into the dye image-receiving layer during the dye transfer step. The thermal dye receiving layer composition can immobilize the dye and stabilize the dye in an intended viewing environment.

The thermal dye receiving layer can include a thermoplastic material, for example, a polyester, a polyolefin, a polycarbonate, a vinyl polymer, a polyurethane, a polyvinyl chloride, a poly(styrene-co-acrylonitrile), a poly(caprolactone), or combinations thereof, such as blends or copolymers.

Polyester-polycarbonate blends suitable for the dye image-receiving layer can include unmodified bisphenol-A polycarbonates having a number molecular weight of at least 25,000, such as those disclosed in U.S. Pat. No. 4,695,286 (Vanier et al.) that is incorporated herein by reference. Specific examples include MAKROLON® 5700 (Bayer AG) and LEXAN 151 (General Electric Co.) polycarbonates.

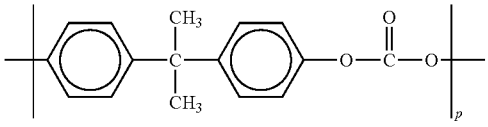

Lexan® 151: p~120, Tg~150° C.

Makrolon® 5700: p~280, Tg~157° C.

For polyester-polycarbonate blends, the polycarbonate can have a Tg of from about 100 to about 250° C., and the polyester can have a lower Tg than the polycarbonate. The Tg of the final polyester-polycarbonate blend can be from about 40 to about 100° C. Higher Tg polyester and polycarbonate polymers also can be used.

According to various embodiments, the thermal dye receiving layer can include a polyester having recurring dibasic acid derived units and diol derived units. A portion of the dibasic acid derived units, for example, at least 50 mole %, can include dicarboxylic acid derived units having an alicyclic ring within two carbon atoms of each carboxyl group of the corresponding dicarboxylic acid. A portion of the diol derived units, for example, at least 30 mole %, can have an aromatic ring not immediately adjacent to each hydroxyl group of the corresponding diol or an alicyclic ring. Examples of such polyesters suitable for thermal dye receiving layers include polyesters such as those found in U.S. Pat. No. 5,387,571 (Daly) that is incorporated herein by reference.

In the case of an extrudable polyester, monomers (as a replacement for either a diacid and/or diol that has three or more functional groups such as one more multifunctional polyols or polyacids, and derivatives thereof) that can provide branching can be used, for example, multifunctional polyols, including but not limited to, glycerin, 1,1,1-trimethylolethane, 1,1,1-trimethylolpropane, and combinations thereof. Polyacids having more than two carboxylic acid groups (including esters or anhydrides derivatives thereof) include but are not limited to, trimellitic acid, trimesic acid, 1,2,5-, 2,3,6- or 1,8,4-naphthalene tricarboxylic anhydride, 3,4,4'-diphenyltricarboxylic anhydride, 3,4,4'-diphenylmethanetricarboxylic anhydride, 3,4,4'-diphenylethertricarboxylic anhydride, 3,4,4'-benzophenonetricarboxylic anhydride acid, and derivatives thereof. Multifunctional polyols or anhydrides, for example, include compounds represented by the following structures:

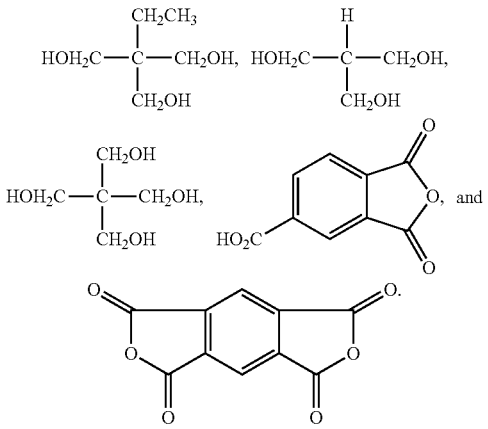

Extrudable branched polyesters can be prepared, for example, from 1,4-cyclohexanedicarboxylic acid, 1,4-cyclohexanedimethanol, 4,4'-bis(2-hydroxyethyl)bisphenol-A, and 2-ethyl-2-(hydroxymethyl)-1,3-propanediol.

Various polymerization catalysts known to practitioners in the art can be used to make the polymers. For example, a catalyst can be added in the amount of from about 0.01% to about 0.08% by weight solids to the polymer composition of the thermal dye receiving layer to prevent or minimize trans esterification.

A plasticizer can be present in the thermal dye receiving layer in any effective amount such as from about 5% to about 100%, or typically from about 4% to about 30%, based on the weight of the polymer in the thermal dye receiving layer. Useful plasticizers include aliphatic ester plasticizers such as monomeric esters and polymeric esters as disclosed in U.S. Pat. No. 6,291,396 (Bodem et al.) that is incorporated herein by reference. Phthalate ester plasticizers are disclosed for example in U.S. Pat. No. 4,871,715 (Harrison et al.) that is incorporated herein by reference.

When the thermal dye receiving layer is made by high temperature melt extrusion, a phosphorous-containing stabilizer can be added to prevent degradation of the polyester polymer blend during extrusion. The phosphorous-containing stabilizer can be a phosphorous acid, an organic diphosphite such as bis(2-ethylhexyl)phosphite, a phosphate, an alkyl phosphate, an aryl phosphate, an inorganic phosphate, a phosphoric acid ester, or a phosphorous acid. The phosphorous stabilizer can be combined with a plasticizer such as dioctyl sebacate or the like. To improve compatibility, the plasticizer can be combined with the stabilizer prior to combining both with other components of the dye image-receiving layer.

The thermal dye receiving layer can also include a release agent such as a modified polydimethylsiloxane. Suitable release agents are known in the art, and can include, for example, those described in U.S. Patent Application Publication 2005/0059552 (Kung et al.). Suitable release agents can include, for example, GP-7101, GP-7105, GP-70-S, GP-74, and GP-154, all available from Genesee Polymers. Other suitable release agents can include, for example, those disclosed in U.S. Pat. Nos. 4,820,687 (Kawasaki et al.) and 4,695,286 (Vanier et al.) that are incorporated herein by reference including Silwet® L-7230 and Silwet® L-7001 that can be obtained from Crompton Corporation and solid polydimethylsiloxanes such as but not limited to MB50-315 silicone, a 50/50 blend of bisphenol-A polycarbonate and ultra-high MW polydimethyl siloxane that can be obtained from Dow Corning.

The release agent can be present in an amount of at least $5.5\times10^{-4}$ g/m$^2$, and for example, at least 0.001 g/m$^2$ and up to 0.02 g/m$^2$.

The release agent can be present in one or more layers of the dye image receiver element including but not limited to the thermal dye receiving layer, the support, an adhesive layer, a tie-layer, an antistatic layer, or any other layer. When the support is a composite or laminate structure, the release agent can be in one or more layers of the support, for example, in a base layer, a tie-layer, an adhesive layer, or a backing layer.

The thermal dye receiving layer can also include alpha-tocopherol or a derivative thereof such as Vitamin E, available as Irganox® E201 from Ciba Specialty Chemicals, Inc. Derivatives can include, for example, α-tocopherol acetates. α-Tocopherol can be present in an amount of at least 0.001 weight percent of the thermal dye receiving layer, for example, from about 0.005 to about 10 weight %.

The release agent and α-tocopherol or a derivative thereof can be present in the thermal dye receiving layer in a ratio of from about 100:1 to about 1:1 by weight or from about 80:1 to about 2:1, depending upon the materials present in the layer.

The thermal dye receiving layer can be present in an amount that is effective for its intended purpose, for example, from about 0.5 g/m$^2$ to about 20 g/m$^2$ but typically from about 1.0 g/m$^2$ to about 15 g/m$^2$. Accordingly, the dry thickness of the dye receiving layer can be of any value to suit its intended use and for example can vary from about 0.5 μm to about 20 μm but typically from about 1 μm to about 15 μm.

The thermal dye receiving layer can be present on one or both sides of the support. The thermal dye receiving layer can be single layered or multi-layered. Multi-layered layers can be formed simultaneously (by co-extrusion or curtain coating or any other method) or sequentially. In order to obtain good adhesion while maintaining desirable sensitometry, the dry thickness ratio of thermal dye receiving layer to the antistatic subbing layer is generally from about 0.2:1 to about 50:1 and typically from about 0.5:1 to about 40:1.

The thermal dye receiving layer can include other optional components including but not limited to, antistatic agents (described below), various non-polyurethane copolymers (such as polyesters, polycarbonates, polycyclohexylenedimethylene terephthalate, and vinyl modified polyester copolymers) as described for example in U.S. Pat. No. 7,189,676 (Bourdelais et al.), plasticizers such as monomeric and polymeric esters as described for example in Col. 4 of U.S. Pat. No. 7,514,028 (Kung et al.), stabilizers, release agents, or coating agents.

Useful antistatic agents include both organic and inorganic compounds that are electrically-conductive that can be either ionic conductors or electronic conductors. Ionic conductors can include simple inorganic salts, alkali metal salts or surfactants, ionic conductive polymers, polymeric electrolytes containing alkali metal salts, colloidal metal oxide sols, and other useful compounds known in the art. These compounds can be incorporated into the thermal dye receiving layer in appropriate amounts for a desired conductivity. Electronic conductors such as polythiophene or conductive metal oxides are more difficult to incorporate into thermally extrudable dye receiving layers because of their poor thermal processability. However, electronic conductors can be incorporated into dye receiving layers that are coated out of water- or solvent-based compositions.

In many embodiments, the thermal dye receiving layer is the outermost layer of the thermal dye image receiver element, but in some embodiments, the element further comprises an outermost layer disposed on the thermal dye receiving layer. This outermost layer can comprise polymers and interpolymers prepared from ethylenically unsaturated monomers such as styrene, styrene derivatives, acrylic acid or methacrylic acid and their derivatives, olefins, chlorinated olefins, (meth)acrylonitriles, itaconic acid and its derivatives, maleic acid and its derivatives, vinyl halides, vinylidene halides, vinyl monomers, vinyl monomer having a primary amine addition salt, vinyl monomer containing an aminostyrene addition salt. Also useful are polymers such as polyurethanes and polyesters. This outermost layer generally has a dry thickness of from about 0.1 to about 15 μm but typically from about 0.25 to about 3 μm.

The thermal dye image receiving element has at least one additional layers between the cellulosic raw base support and the thermal dye image receiving layer, and at least one of those additional layers is an antistatic subbing layer (as described below).

Antistatic Subbing Layer

The antistatic subbing layer comprises a film-forming polymer binder that can be one or more of a water soluble polymer, a hydrophilic colloid or a water insoluble polymer latex or dispersion and is humidity insensitive, in order to ensure invariant performance under a wide range of humidity conditions at users end. In this regard, it is desired that the film-forming polymer, upon drying, absorbs less than 10% and typically less than 5%, or more typically less than 1% of its weight of moisture under 80% RH at 23° C. In some embodiments, the antistatic subbing layer is aqueous-coated, meaning that it is coated out of a coating medium that is at least 50 volume % (of total solvents) water.

Particularly useful polymer binders are selected from the group of polymers and interpolymers prepared from ethylenically unsaturated monomers such as styrene, styrene derivatives, acrylic acid or methacrylic acid and their derivatives, olefins, chlorinated olefins, (meth)acrylonitriles, itaconic acid and its derivatives, maleic acid and its derivatives, vinyl halides, vinylidene halides, vinyl monomer having a primary amine addition salt, vinyl monomer containing an aminostyrene addition salt. Also useful are polymers such as polyurethanes and polyesters. It is desirable that the Tg of the binder polymer is below 45° C., typically below 40° C., and ideally at or below 15° C., in order to ensure sufficient flow during thermal extrusion of the dye receiving layer over the subbing layer, and thus afford adhesion. The Tg can be determined using known procedures including the use of differential scanning calorimetry. The binder polymer can be semi-crystalline or amorphous, the latter being preferable. Particularly useful binder polymers are those disclosed in U.S. Pat. Nos. 6,171,769, 6,120,979, 6,077,656, 6,811,724, and 6,835,516 all of which are incorporated herein by reference.

The antistatic subbing layer comprises an electrically conductive material or antistatic agent (identified herein as the "second antistatic agent"). Any electrically conductive material can be used for this purpose.

Electrically conductive materials can be divided into two broad groups: (i) ionic conductors and (ii) electronic conductors. In ionic conductors charge is transferred by the bulk diffusion of charged species through an electrolyte. Although relatively inexpensive, the resistivity is dependent on temperature and humidity. The conductivity of an electronic conductor depends on electronic mobility rather than ionic mobility and is independent of humidity. Electronically conducting materials can be expensive and may impart unfavorable physical characteristics, such as color, increased brittleness and poor adhesion.

Electronic conductors such as conjugated conducting polymers, conducting carbon particles including single- or multi-walled carbon nanotubes, buckyballs, graphene, crystalline semiconductor particles, amorphous semiconductive fibrils, and continuous conductive metal or semiconducting thin films can be used in this invention to afford humidity independent antistatic protection. Of the various types of electronic conductors, electronically conductive metal-containing particles, such as semiconducting metal oxides, and electronically conductive polymers, such as, substituted or unsubstituted polythiophenes, substituted or unsubstituted polypyrroles, and substituted or unsubstituted polyanilines are particularly effective for the present invention.

Conductive metal-containing particles, which may be used in the present invention, include conductive metal particles, inorganic oxides, metal antimonates, and inorganic non-oxides. Particularly suitable inorganic oxides include crystalline inorganic oxides such as zinc oxide, titania, tin oxide, alumina, indium oxide, silica, magnesia, barium oxide, molybdenum oxide, tungsten oxide, and vanadium oxide or composite oxides thereof, as described in, for example, U.S. Pat. Nos. 4,275,103, 4,394,441, 4,416,963, 4,418,141, 4,431,764, 4,495,276, 4,571,361, 4,999,276 and 5,122,445, all incorporated herein by reference. The conductive crystalline inorganic oxides may contain a "dopant" in the range from 0.01 to 30 mole percent, preferred dopants being aluminum or indium for zinc oxide, niobium or tantalum for titania, and antimony, niobium or halogens for tin oxide. Alternatively, the conductivity can be enhanced by formation of oxygen defects by methods well known in the art. Tin oxide and vanadium pentoxide (or mixture thereof) are particularly useful antistatic agents in some embodiments of the antistatic subbing layer. Metal oxides can be present in an amount of from about 10 to about 90 weight % based on the total dry antistatic subbing layer weight.

Another useful category of electronically conductive metal-containing particles, which may be used in the layer of the invention, includes acicular doped metal oxides, acicular metal oxide particles, and acicular metal oxides containing oxygen deficiencies. In this category, acicular doped tin oxide particles, particularly acicular antimony-doped tin oxide particles, acicular niobium-doped titanium dioxide particles, and the like are preferred because of their availability. The aforesaid acicular conductive particles preferably have a cross-sectional diameter less than or equal to 0.02 μm and an aspect ratio greater than or equal to 5:1. Some of these acicular conductive particles, useful for the present invention, are described in U.S. Pat. Nos. 5,719,016, 5,731,119, and 5,939,243 and references therein, all incorporated herein by reference.

The volume fraction of the acicular electronically conductive metal oxide particles in the dried antistatic subbing layer can vary from about 10 to about 90% and typically from about 2 to about 50% for optimum physical properties. For non-acicular electronically conductive metal oxide particles, the volume fraction can vary from about 10 to about 90%, and typically from about 5 to about 80% for optimum properties.

The conductive agent can also be a conductive "amorphous" gel such as vanadium oxide gel comprised of vanadium oxide ribbons or fibers. Such vanadium oxide gels may be prepared by any variety of methods, including but not specifically limited to melt quenching as described in U.S. Pat. No. 4,203,769, incorporated herein by reference, ion exchange as described in DE 4,125,758, incorporated herein by reference, or hydrolysis of a vanadium oxoalkoxide as claimed in WO 93/24584, incorporated herein by reference. The vanadium oxide gel can be doped with silver to enhance conductivity. Other methods of preparing vanadium oxide gels, which are well known in the literature, include reaction of vanadium or vanadium pentoxide with hydrogen peroxide and hydrolysis of $VO_2OAc$ or vanadium oxychloride.

Conductive metal antimonates suitable for use in accordance with the invention include those as disclosed in, U.S. Pat. Nos. 5,368,995 and 5,457,013, for example, both incorporated herein by reference. Useful conductive metal antimonates have a rutile or rutile-related crystallographic structures. Several colloidal conductive metal antimonate dispersions are commercially available from Nissan Chemical Company in the form of aqueous or organic dispersions. If used, the volume fraction of the conductive metal antimonates in the dried antistatic subbing layer can vary from about 10 to about 90%, or typically from about 20 to about 80%.

Conductive inorganic non-oxides suitable for use as conductive particles in the present invention include metal nitrides, metal borides and metal silicides, which may be acicular or non-acicular in shape. Examples of these inorganic non-oxides include titanium nitride, titanium boride, titanium carbide, niobium boride, tungsten carbide, lanthanum boride, zirconium boride, molybdenum boride and the like. Examples of conductive carbon particles, suitable for incorporation in the layer of the invention as conductive agent, include carbon black and carbon fibrils or nanotubes with single walled or multi-walled morphology. Example of such suitable conductive carbon particles can be found in U.S. Pat. No. 5,576,162 and references therein, incorporated herein by reference.

Suitable electrically conductive polymers that are useful in the antistatic subbing layer are specifically electronically conducting polymers, such as those illustrated in U.S. Pat. Nos. 6,025,119, 6,060,229, 6,077,655, 6,096,491, 6,124,083, 6,162,596, 6,187,522, and 6,190,846, all incorporated herein by reference. These electronically conductive polymers include conjugated polymers such as substituted or unsubstituted aniline-containing polymers (as disclosed in U.S. Pat. Nos. 5,716,550, 5,093,439 and 4,070,189, both incorporated herein by reference), substituted or unsubstituted thiophene-containing polymers (as disclosed in U.S. Pat. Nos. 5,300,575, 5,312,681, 5,354,613, 5,370,981, 5,372,924, 5,391,472, 5,403,467, 5,443,944, 5,575,898, 4,987,042 and 4,731,408, all incorporated herein by reference), substituted or unsubstituted pyrrole-containing polymers (as disclosed in U.S. Pat. Nos. 5,665,498 and 5,674,654, both incorporated herein by reference), and poly(isothianaphthene) or derivatives thereof. These conducting polymers may be soluble or dispersible in organic solvents or water or mixtures thereof. Useful conducting polymers for the present invention include polypyrrole styrene sulfonate [referred to as polypyrrole/poly(styrene sulfonic acid) in U.S. Pat. No. 5,674,654, incorporated herein by reference], 3,4-dialkoxy substituted polypyrrole styrene sulfonate, and 3,4-dialkoxy substituted polythiophene styrene sulfonate because of their color, such as poly(3,4-ethylene dioxythiophene styrene sulfonate) available as Clevios® P, PHC, PAG supplied by H.C. Starck Corporation. The weight % of the electronically conductive polymer in the dried antistatic subbing layer can vary from about 1 to about 99% and typically from about 1 to about 20%. Suitable conductivity enhancing agents (CEA) such as organic compounds containing dihydroxy, polyhydroxy, carboxyl, amide, or lactam groups, can be added to the conductive polymer for increased conductivity, as described in U.S. Pat. No. 7,427,441 and references therein. Particularly suitable CEA's include sugar, sugar derivatives, ethylene glycol, glycerol, di- or triethylene glycol, N-methylpyrrolidone, pyrrolidone, caprolactam, N-methyl caprolactam, dimethyl sulfoxide, and N-octylpyrrolidone.

Humidity dependent, ionic conductors are traditionally more cost-effective than electronic conductors and find widespread use in reflective imaging media such as paper. Any such ionic conductor can be incorporated in the antistatic subbing layer. The ionic conductors can comprise an inorganic or organic salt. Alkali metal salts particularly those of polyacids are effective. The alkali metal can comprise lithium, sodium or potassium and the polyacid can comprise poly(acrylic acid) or poly(methacrylic acid), maleic acid, itaconic acid, crotonic acid, polysulfonic acid or mixed polymers of these compounds, as well as cellulose derivatives. The alkali salts of polystyrene sulfonic acid, napthalene sulfonic acid or an alkali cellulose sulfate are useful.

Polymerized alkylene oxides, particularly combinations of polymerized alkylene oxides and alkali metal salts, described in U.S. Pat. Nos. 4,542,095 and 5,683,862 that are incorporated herein by reference, are also useful. Specifically, a combination of a polyethylene ether glycol and lithium nitrate is a desirable choice because of its performance and cost. In such a combination, the combined weight % of the polyethylene ether glycol and lithium nitrate in the dry subbing layer can vary from about 1 to about 50%. Furthermore, in such a combination, the weight ratio of polyethylene ether glycol to lithium nitrate in the dry antistatic subbing layer can vary from about 1:99 to about 99:1 and typically from about 20:80 to about 80:20.

Also, useful are inorganic particles such as electrically conductive synthetic or natural smectite clay as conductive agents.

Also useful are those ionic conductors that are disclosed in U.S. Pat. Nos. 5,683,862, 5,869,227, 5,891,611, 5,981,126, 6,077,656, 6,120,979, 6,171,769, and references therein, all incorporated herein by reference.

The conductive particles that can be incorporated in the aqueous-coated antistatic subbing layer are not specifically limited in particle size or shape. The particle shape may range from roughly spherical or equiaxed particles to high aspect ratio particles such as fibers, whiskers, tubes, platelets or ribbons. Additionally, the conductive materials described above may be coated on a variety of other particles, also not particularly limited in shape or composition. For example the conductive inorganic material may be coated on non-conductive silica, alumina, titania and mica particles, whiskers or fibers.

The antistatic subbing layer may comprise a colloidal sol, which may or may not be electrically conductive, to improve physical properties such as durability, roughness, coefficient of friction, as well as to reduce cost. Useful colloidal sols include finely divided inorganic particles in a liquid medium such as water. The inorganic particles can be metal oxide based including but not limited to, tin oxide, titania, antimony oxide, zirconia, ceria, yttria, zirconium silicate, silica, alumina, such as boehmite, aluminum modified silica, as well as other inorganic metal oxides of Group III and IV of the Periodic Table and mixtures thereof. Inorganic particles such as silicon carbide, silicon nitride and magnesium fluoride when in sol form are also useful for the present invention. The inorganic particles of the sol have an average particle size less than 100 nm and typically less than 40 nm. A variety of colloidal sols are commercially available from DuPont, Nalco Chemical Co., and Nyacol Products Inc. The weight % of the inorganic particles of the sol is generally at least 5% and more preferred to be at least 10% of the dried layer of the invention to achieve the desired physical properties.

The antistatic subbing layer can comprise other addenda for any specific use such as surfactants, defoamers or coating aids, charge control agents, thickeners or viscosity modifiers, coalescing aids, crosslinking agents or hardeners, soluble or solid particle dyes, antifoggants, fillers, matte beads, inorganic or polymeric particles, adhesion promoting agents, bite solvents or chemical etchants, lubricants, plasticizers, antioxidants, voiding agents, colorants or tints, roughening agents, slip agent, UV absorbers, and others well known in the art.

The antistatic subbing layer can be placed anywhere in the thermal dye image receiver element to fulfill any specific purpose. However, it is usually placed between the cellulosic raw base substrate and the thermal dye receiving layer.

For desirable static protection, the antistatic subbing layer may have a SER value of less than 13 log ohms/square, or typically less than 12 log ohms/square, or more typically less than 11 log ohms/square. This SER value is at least 1 log ohm/square lower than the WER value of the cellulosic raw base support.

The aqueous subbing layer can be of any coverage such as from about 10 to about 2000 mg/m$^2$ and typically from about 50 to about 500 mg/m$^2$. The thickness of the subbing layer can vary from 0.01 μm to 2 μm and typically from 0.05 μm to 0.5 μm.

It is also possible that an extruded tie (or antistatic) layer be used in the thermal dye receiver elements of this invention. Details of such extruded layers are provided in U.S. Pat. No. 6,897,183 (Arrington et al.) and U.S. Patent Application Publication 2004/0167020 (Arrington et al.), both of which are incorporated herein by reference.

Thermal Dye Image Receiving Element Support

The support for the thermal dye image receiver element includes a cellulosic raw base material such as a cellulosic raw paper comprising natural pulp paper mainly composed of wood pulp such as soft wood pulp, hard wood pulp, and mixed pulp of soft wood and hard wood. For example, the wood sources can be maple or eucalyptus trees. Bleached hardwood chemical kraft pulp is particularly useful for this invention as it provides brightness, a smooth starting surface, and good formation while maintaining strength. The wood fibers may be mixed with linen or other fabric fibers. Additionally, the raw base may contain, in any combinations, various high molecular compounds and additives, such as, dry strength increasing agents, sizing agents, wet strength increasing agents, stabilizers, pigments, fillers such as $TiO_2$, talc, mica, $BaSO_4$, $CaCO_3$, clays, starch, dyes, fluorescent whiteners or optical brighteners, latexes, electrolytes such as sodium and calcium chloride, and pH regulators.

The support can be employed at any desired thickness, for example, from about 10 μm to about 1000 μm or typically from about 100 μm to about 250 μm.

In a useful embodiment, the raw base comprising cellulosic paper is either laminated or resin-coated on the image receiving side and the backside. The thickness of the laminating film or the resin-coating can vary from about 5 μm to about 100 μm.

If laminated, the laminate film on the image receiving side comprises a voided layer that provides a compliant and thermally diffusive layer suitable for thermal dye transfer, and optionally a skin layer on the compliant layer. The skin layer may be voided or non-voided, and may contain inorganic particles or colorants.

Alternatively, if the paper is resin-coated on the imaging side, it may have a compliant and thermally diffusive resin coating underneath the antistatic subbing layer, optionally comprising a skin layer further comprising inorganic particles or colorants. Such a compliant resin may comprise multiple resins, at least some of which are elastomeric [such as polyolefin blends, styrene block copolymers (SBC) like styrene-ethylene/butylene styrene (SEBS) or styrene-ethylene/propylene styrene (SEPS) or styrene butadiene styrene (SBS) or styrene isoprene styrene (SIS), polyether block polyamide (Pebax® type polymers), thermoplastic copolyester elastomer (COPE), thermoplastic urethanes (TPU) and semicrystalline polyolefin polymers such as ethylene/propylene copolymers (for example, available as Vistamaxx™ polymers)], other resins that are non-elastomeric "matrix" resins [including polyolefins such as polyethylene, polypropylene, their copolymers, functionalized or grafted polyolefins, polystyrene, polyamides like amorphous polyamide (like Selar), and polyesters], and an optional amorphous or semi-crystalline additive polymer such as cyclic olefins, polystyrenes, maleated polyethylene (such as Dupont Bynel® grades, Arkema's Lotader® grades).

The backside of the paper can also be laminated with a suitable film or resin-coated with a suitable resin. The laminate film used on the backside typically comprises an oriented polymer, such as biaxially oriented polypropylene or polyester.

The backside resin-coating, can comprise polyolefins such as polyethylene and polypropylene, polyolefin acrylates, polyurethane, polystyrene, or elastomeric polymers. Such supports are well known in the art, for example, as disclosed in commonly assigned U.S. Pat. Nos. 5,244,861 and 5,928,990 and EP 0 671 281A1 that are incorporated herein by reference.

The cellulosic raw paper support has a WER value that is at least 1 log ohm/square greater (typically at least 1.5 log ohm/square greater) than the SER value of the antistatic subbing layer described above.

To achieve this relationship, the cellulosic raw paper base contains one or more antistatic agents that can be the same or different than those in the antistatic subbing layer. Typically, the "first" antistatic agents in the cellulosic raw paper base are different than the "second" antistatic agents in the antistatic subbing layer.

These "first" antistatic agents can be any of the compounds described above for the antistatic subbing layer including the metal oxides and electronically conductive polymers. Typically, antistatic agents in the cellulosic raw paper substrate are inorganic or organic electrolytes. Alkali metal and alkaline earth salts (or electrolytes) such as sodium chloride, potassium chloride, and calcium chloride, and particularly electrolytes comprising polyacids are effective. The alkali metal can comprise lithium, sodium, or potassium and the polyacid can comprise polyacrylic or poly(methacrylic acid), maleic acid, itaconic acid, crotonic acid, poly(sulfonic acid) or mixed polymers of these compounds, as well as cellulose derivatives. Alternatively, the raw base support may contain various clays such as smectite clays that can include exchangeable ions that impart conductivity to the raw base support.

Polymerized alkylene oxides, particularly combinations of polymerized alkylene oxides and alkali metal salts, described in U.S. Pat. Nos. 4,542,095 and 5,683,862 are also useful as electrolytes.

The one or more antistatic agents such as the organic or inorganic electrolytes can be present in the cellulosic raw base support in an amount of up to 0.5 weight % or typically from about 0.01 to about 0.4 weight %, or even from about 0.05 to about 0.3 weight %, based on the total dry substrate weight.

Other Layers

The thermal dye receiver element may comprise any number of optional layer(s) for various functions. These functional layers can include writable or back-printable layers, scratch or abrasion resistant layers, friction control layers, curl control layers, barrier layers, interlayers, adhesion promoting layers, additional antistatic layers and other layer known in the art.

In some embodiments, the image receiver elements are "dual-sided", meaning that they have an image receiving layer (such as a thermal dye receiving layer) on both sides of the support.

Dye Donors Elements

Ink or thermal dye-donor elements that may be used with the thermal dye image receiver element generally comprise a support having thereon an ink or dye containing layer.

Any ink or dye may be used in the thermal ink or dye-donor provided that it is transferable to the thermal ink or dye-receiving or recording layer by the action of heat. Ink or dye donor elements useful with the present invention are described, for example, in U.S. Pat. Nos. 4,916,112, 4,927,803, and 5,023,228 that are all incorporated herein by reference. As noted above, ink or dye-donor elements may be used to form an ink or dye transfer image. Such a process comprises image-wise-heating an ink or dye-donor element and transferring an ink or dye image to a thermal dye image receiving element as described above to form the ink or dye transfer image. The thermal ink or dye transfer method of printing, an ink or dye donor element may be employed that comprises a poly(ethylene terephthalate) support coated with sequential repeating areas of cyan, magenta, or yellow ink or dye, and the ink or dye transfer steps may be sequentially performed for each color to obtain a multi-color ink or dye transfer image. The support may also include a clear protective layer that can be transferred onto the transferred dye images. When the process is performed using only a single color, then a monochrome ink or dye transfer image may be obtained.

Dye donor elements that may be used with the thermal dye image receiving element conventionally comprise a support having thereon a dye containing layer. Any dye can be used in the dye layer of the dye-donor element of the invention provided it is transferable to the dye-receiving layer by the action of heat. Especially good results have been obtained with diffusible dyes, such as the magenta dyes described in U.S. Pat. No. 7,160,664 (Goswami et al.) that is incorporated herein by reference.

The dye donor layer can also include a single color area (or patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include a magenta dye combination and further comprise a yellow dye-donor patch comprising at least one bis-pyrazolone-methine dye and at least one other pyrazolone methine dye, and a cyan dye-donor patch comprising at least one indoaniline cyan dye.

Any dye transferable by heat can be used in the dye-donor layer of the dye donor element. The dye can be selected by taking into consideration hue, lightfastness, and solubility of the dye in the dye donor layer binder and the dye image receiving layer binder.

Further examples of useful dyes can be found in U.S. Pat. Nos. 4,541,830; 4,698,651; 4,695,287; 4,701,439; 4,757,046; 4,743,582; 4,769,360; 4,753,922; 4,910,187; 5,026,677; 5,101,035; 5,142,089; 5,374,601; 5,476,943; 5,532,202; 5,804,531; 6,265,345, 7,501,382 (Foster et al.), and U.S. Patent Application Publications 2003/0181331 and 2008/0254383 (Soejima et al.), the disclosures of which are hereby incorporated by reference.

The dyes can be employed singly or in combination to obtain a monochrome dye-donor layer or a black dye-donor layer. The dyes can be used in an amount of from about 0.05 to about 1 g/m$^2$ of coverage. According to various embodiments, the dyes can be hydrophobic.

Imaging and Assemblies

As noted above, dye donor elements and thermal dye image receiver elements can be used to form a dye transfer image. Such a process can comprise imagewise-heating a thermal dye donor element and transferring a dye image to a thermal dye image receiver element as described above to form the dye transfer image.

In one embodiment of the invention, a thermal dye donor element may be employed which comprises a poly(ethylene terephthalate) support coated with sequential repeating areas of cyan, magenta and yellow dye, and the dye transfer steps are sequentially performed for each color to obtain a three-color dye transfer image. The dye donor element may also contain a colorless area that may be transferred to the thermal dye image receiving element to provide a protective overcoat.

Thermal printing heads which may be used to transfer ink or dye may be available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal ink or dye transfer may be used, such as lasers as described in, for example, GB Publication 2,083,726A that is incorporated herein by reference.

A thermal transfer assemblage may comprise (a) an ink or dye-donor element, and (b) a thermal dye image receiver element, the ink or dye thermal dye image receiver element being in a superposed relationship with the ink or dye donor element so that the ink or dye layer of the donor element may be in contact with the ink or thermal dye image receiving layer. Imaging can be obtained with this assembly using known processes.

When a three-color image is to be obtained, the above assemblage may be formed on three occasions during the time when heat may be applied by the thermal printing head. After the first dye is transferred, the elements may be peeled apart. A second dye donor element (or another area of the donor element with a different dye area) may be then brought in register with the thermal dye receiving layer and the process repeated. The third color may be obtained in the same manner.

In preferred embodiments, an additional clear protective overcoat is transferred from the donor element (either from a separate donor element or from an overcoat patch of a donor element containing color patches) over the three-color image for physical protection of the image.

The following embodiments are representative of those included within the present invention:

1. A thermal dye image receiver element comprising, in order:

a cellulosic raw base support, an antistatic subbing layer, and a thermal dye receiving layer, wherein the cellulosic raw base support has an internal electrical resistance (WER) that is at least 1 log ohm/square greater than the surface electrical resistance (SER) of the antistatic subbing layer.

2. The element of embodiment 1 wherein the internal electrical resistance (WER) of the cellulosic raw base support is at least 1.5 log ohm/square greater than the surface electrical resistance (SER) of the antistatic subbing layer.

3. The element of embodiment 1 or 2 wherein the cellulosic raw base support comprises a first antistatic agent that is different than a second antistatic agent in the antistatic subbing layer.

4. The element of any of embodiments 1 to 3 wherein the antistatic subbing layer comprises a polymer binder and a metal oxide.

5. The element of embodiment 4 wherein the metal oxide is present in the antistatic subbing layer in an amount of from about 10 to about 90 weight % based on the total dry layer weight.

6. The element of embodiment 4 or 5 wherein the antistatic subbing layer comprises tin oxide.

7. The element of any of embodiments 1 to 3 wherein the antistatic subbing layer comprises a polymer binder and an electronically conductive polymer that is 3,4-dialkoxy-substituted polythiophene styrene sulfonate.

8. The element of embodiment 7 wherein the electronically conductive polymer is present in the antistatic subbing layer in an amount of from about 1 to about 20 weight % of the total dry layer weight.

9. The element of any of embodiments 1 to 8 wherein the cellulosic raw base support comprises an electrolyte in an amount of up to 0.5 weight % based on total dry base support weight.

10. The element of any of embodiments of 1 to 9 wherein the cellulosic raw base support comprises an electrolyte in an amount of from about 0.01 to about 4 weight % based on total dry base support weight.

11. The element of any of embodiments 1 to 10 further comprising a compliant layer between the cellulosic raw base support and the antistatic subbing layer.

12. The element of embodiment 11 wherein the compliant layer is a voided compliant layer.

13. The element of any of embodiments 1 to 12 wherein the cellulosic raw base support has a dry thickness of from about 10 to about 1000 μm, the antistatic subbing layer has a dry thickness of from about 0.01 to about 2 μm, and the thermal dye receiving layer has a dry thickness of from about 0.5 to about 20 μm.

14. The element of any of embodiments 1 to 13 wherein the antistatic subbing layer is an aqueous-coated layer.

15. The element of any of embodiments 1 to 14 wherein the thermal dye receiving layer also comprises an antistatic agent distributed within a polymer binder.

16. An assembly comprising the thermal dye image receiver element of any of embodiments 1 to 15 and a thermal dye donor element.

17. The assembly of embodiment 16 wherein the internal electrical resistance (WER) of the cellulosic raw base support is at least 1.5 log ohm/square greater than the surface electrical resistance (SER) of the antistatic subbing layer, and the antistatic subbing layer comprises tin oxide in an amount of from about 1 to about 70 weight % based on dry subbing layer weight, and the cellulosic raw base support comprises an electrolyte in an amount of up to 0.5 weight % based on total dry base support weight.

18. The assembly of embodiment 16 or 17 wherein the internal electrical resistance (WER) of the cellulosic raw base support is at least 1.5 log ohm/square greater than the surface electrical resistance (SER) of the antistatic subbing layer, and the antistatic subbing layer comprises 3,4-dialkoxy substituted polythiophene styrene sulfonate in an amount of from about 1 to about 20 weight % based on dry subbing layer weight, and the cellulosic raw base support comprises an electrolyte in an amount of from about 0.01 to about 0.4 weight % based on total dry base support weight.

The following Examples are provided to illustrate the practice of the present invention, but the invention is not to be limited by the Examples in any manner.

EXAMPLES

Cellulosic raw base (paper) samples were prepared having two levels of sodium chloride using a paper manufacturing machine as detailed in TABLE I below.

TABLE I

| Raw Base Sample | Sodium Chloride Coverage (g/m$^2$) |
|---|---|
| "low" salt | 0.02 |
| "high" salt | 1.13 |

These samples were laminated with commercially available BOPP films on both sides. The imaging side BOPP film was a composite film (~37 μm thick and specific gravity of 0.7) comprising a microvoided and oriented polypropylene core and a non-microvoided and oriented polypropylene layer coextruded on each side, and further comprising titanium dioxide pigment. The BOPP film on the opposite (non-imaging) side was non-voided (~21 μm thick and specific gravity of 1.0) with a matte finish. These raw base samples laminated with BOPP films were used as the "low" salt and "high" salt thermal receiver substrates that were used in the Invention and Comparative Examples described below.

The WER values of the support samples were determined as follows:

The samples were conditioned at 20% RH for 24 hours. Subsequently, the WER value (henceforth to be referred as $WER_{sup}$) was determined following the procedure described in R. A. Elder, "Resistivity Measurements on Buried Conductive Layers", EOS/ESD Symposium proceedings, September 1990, pages 251-254. The data are provided in TABLE II below.

TABLE II

| Substrate Sample | Raw base Sodium Chloride (g/m$^2$) | $WER_{sup}$ (log ohm/square) |
|---|---|---|
| "low" salt | 0.02 | 10.6 |
| "high" salt | 1.13 | 9.8 |

The "low" salt and "high" salt supports described above were coated with aqueous subbing layers of various compositions, in a manner as described in U.S. Patent Application Publication 2008-0220190 (Majumdar et al.). The dry aqueous subbing layers comprised the following ingredients in various ratios:

antimony doped tin oxide: FS 10D (supplied by Ishihara Corporation), and polyurethane latex: Neorez® R600 (supplied by DSM Neoresins).

The surface electrical resistance (SER) of the dry aqueous subbing layers (henceforth to be referred as $SER_{sub}$) was measured with a Trek Surface Resistance meter Model 152P-CR using concentric ring electrodes, following the ANSI/ESD STM 11.11 standard. The following TABLE III provides the details of the aqueous subbing layers.

TABLE III

| Tin Oxide/ Polyurethane Weight Ratio | Dry Subbing Layer Coverage (g/m$^2$) | $SER_{sub}$ on "low" salt Support (log ohm/square) | $SER_{sub}$ on "high" salt Support (log ohm/square) |
|---|---|---|---|
| 0/100 | 0.32 | >13 | >13 |
| 16/84 | 0.32 | 10.3 | 10.5 |
| 24/76 | 0.32 | 9.4 | 9.4 |
| 32/68 | 0.32 | 8.9 | 9 |
| 40/60 | 0.32 | 8.6 | 8.6 |
| 50/50 | 0.32 | 8.1 | 8 |
| 60/40 | 0.32 | 7.8 | 8.2 |
| 70/30 | 0.32 | 7.5 | 7.6 |

The following TABLES IVA and IVB provide a comparison of the $SER_{sub}$ (data from TABLE III) and the $WER_{sup}$ (data from TABLE II) and their difference ($WER_{sup}-SER_{sub}$) for each aqueous subbing layer variation on the "low" salt and "high" salt cellulosic raw base supports, respectively.

TABLE IVA ("low" salt support)

| Tin oxide/-polyurethane weight ratio | $WER_{sup}$ "low" salt support (log ohm/square) | $SER_{sub}$ "low" salt support (log ohm/square) | $WER_{sup}$-$SER_{sub}$ "low" salt support (log ohm/square) |
|---|---|---|---|
| 0/100 | 10.6 | >13 | <−2.4 |
| 16/84 | | 10.3 | 0.3 |
| 24/76 | | 9.4 | 1.2 |
| 32/68 | | 8.9 | 1.7 |
| 40/60 | | 8.6 | 2 |
| 50/50 | | 8.1 | 2.5 |
| 60/40 | | 7.8 | 2.8 |
| 70/30 | | 7.5 | 3.1 |

TABLE IVB ("high" salt support)

| Tin oxide/-polyurethane weight ratio | $WER_{sup}$ "high" salt support (log ohm/square) | $SER_{sub}$ "high" salt support (log ohm/square) | $WER_{sup}$-$SER_{sub}$ "high" salt support (log ohm/square) |
|---|---|---|---|
| 0/100 | 9.8 | >13 | <−3.2 |
| 16/84 | | 10.5 | −0.7 |
| 24/76 | | 9.4 | 0.4 |
| 32/68 | | 9 | 0.8 |
| 40/60 | | 8.6 | 1.2 |
| 50/50 | | 8 | 1.8 |
| 60/40 | | 8.2 | 1.6 |
| 70/30 | | 7.6 | 2.2 |

A 2 μm thick dye receiving layer (DRL) was thermally extruded onto each "low" salt and "high" salt support sample coated with various aqueous subbing layers. The extruded DRL contained of the following ingredients:

a branched polyester (described as E2 in U.S. Pat. No. 6,897,183 at Col. 15, lines 3-32), 72% by weight,
a polycarbonate, 17% by weight,
silicone-containing polymer, 6% by weight,
dioctyl sebacate, 5% by weight, and
phosphorous acid, trace<0.05% by weight.

The resulting thermal dye image receiver elements were finished to standard rolls of 6 inch (15.24 cm) width and 365 feet (110.6 m) length each. Each variation was thermally printed in a KODAK® 7000 photoprinter using standard Kodak thermal dye donors for further evaluation.

Electrostatic Evaluation:

Each variation of the thermal dye image receiver elements was printed with flat field $D_{max}$ density (optical density of>2.0). The polar charge generated on the $D_{max}$ print as a result of dye transfer and the transfer of a protective overcoat from the donor, was measured using a laboratory arrangement. In this arrangement, the $D_{max}$ print was adhered flat on a grounded plate, and the voltage due to the polar charge on the resulting print was measured by scanning two electrometer probes simultaneously across the surface of the print. The measurement was repeated for three prints and the average voltage out of these six measurements (3 prints×2 probes) was reported for each element. The measured voltage was directly proportional to the polar charge on the print, that is, the higher the absolute value of the measured voltage, the higher the polar charge.

In thermal dye printing, it has been found that higher polar charge (absolute value without regards to the sign) leads to higher print sticking when a number of prints accumulate in the tray for pick-up and sorting. Print sticking makes it difficult for the user to subsequently handle prints that is to shuffle and stack prints, sort orders, separate prints, and other handling operations.

The absolute value of the voltage due to polar charge can be qualitatively categorized in the following way:

| Polar Charge (Volts) | Degree |
|---|---|
| <50 | very low |
| 50-100 | low |
| >100 | high |

Lower polar charges are more desirable so the prints are more easily handled without problems.

In the following TABLES V and VI, the polar charge data and the ($WER_{sup}$−$SER_{sub}$) values for each variation of thermal dye image receiver element are provided for the "low" salt and "high" salt substrates, respectively.

TABLE V ("low" salt support)

| Tin oxide/-polyurethane weight ratio | $WER_{sup}$ "low" salt Support (log ohm/square) | $SER_{sub}$ "low" salt Support (log ohm/square) | $WER_{sup}$-$SER_{sub}$ "low" salt Support (log ohm/square) | Polar charge (V) |
|---|---|---|---|---|
| 0/100 | 10.6 | >13 | <−2.4 | −133.6 (high) |
| 16/84 | | 10.3 | 0.3 | −163.2 (high) |
| 24/76 | | 9.4 | 1.2 (Invention) | −58.3 (low) |
| 32/68 | | 8.9 | 1.7 (Invention) | −66.0 (low) |
| 40/60 | | 8.6 | 2 (Invention) | −33.6 (very low) |
| 50/50 | | 8.1 | 2.5 (Invention) | −23.1 (very low) |
| 60/40 | | 7.8 | 2.8 (Invention) | −9.5 (very low) |
| 70/30 | | 7.5 | 3.1 (Invention) | −4.2 (very low) |

TABLE VI ("high" salt support)

| Tin oxide/ polyurethane weight ratio | $WER_{sup}$ "low" salt Support (log ohm/square) | $SER_{sub}$ "high" salt Support (log ohm/square) | $WER_{sup}$-$SER_{sub}$ "high" salt Support (log ohm/square) | Polar charge (V) |
|---|---|---|---|---|
| 0/100 | 9.8 | >13 | <−3.2 | −141.3 (high) |
| 16/84 | | 10.5 | −0.7 | −140.0 (high) |
| 24/76 | | 9.4 | 0.4 | −135.8 (high) |
| 32/68 | | 9 | 0.8 | −153.4 (high) |
| 40/60 | | 8.6 | 1.2 (Invention) | −82.6 (low) |
| 50/50 | | 8 | 1.8 (Invention) | −49.9 (very low) |
| 60/40 | | 8.2 | 1.6 (Invention) | −12.8 (very low) |
| 70/30 | | 7.6 | 2.2 (Invention) | −7.6 (very low) |

The data in TABLES V and VI show that the absolute value of the voltage due to polar charge decreases as the ($WER_{sup}$−$SER_{sub}$) value increases. When the ($WER_{sup}$−$SER_{sub}$) value is<1, the voltage due to polar charge is undesirably high. When the ($WER_{sup}$–$SER_{sub}$) value is between 1 and 1.8, the voltage due to polar charge is desirably low, according to the present invention. Furthermore, when the ($WER_{sub}$–$SER_{sub}$) value is equal to or greater than 1.8 the voltage due to polar charge is even more desirably very low, according to the present invention.

The invention has been described in detail with particular reference to certain preferred embodiments thereof, but it will be understood that variations and modifications can be effected within the spirit and scope of the invention.

The invention claimed is:

1. A thermal dye image receiver element comprising, in order:

a cellulosic raw base support, an antistatic subbing layer, and a thermal dye receiving layer, wherein the cellulosic raw base support has an internal electrical resistance (WER) that is at least 1 log ohm/square greater than the surface electrical resistance (SER) of the antistatic subbing layer.

2. The element of claim 1 wherein the internal electrical resistance (WER) of the cellulosic raw base support is at least 1.5 log ohm/square greater than the surface electrical resistance (SER) of the antistatic subbing layer.

3. The element of claim 1 wherein the cellulosic raw base support comprises a first antistatic agent that is different than a second antistatic agent in the antistatic subbing layer.

4. The element of claim 1 wherein the antistatic subbing layer comprises a polymer binder and a metal oxide.

5. The element of claim 4 wherein the metal oxide is present in the antistatic subbing layer in an amount of from about 10 to about 90 weight % based on the total dry layer weight.

6. The element of claim 4 wherein the antistatic subbing layer comprises tin oxide.

7. The element of claim 1 wherein the antistatic subbing layer comprises a polymer binder and an electronically conductive polymer.

8. The element of claim 7 wherein the electronically conductive polymer is present in the antistatic subbing layer in an amount of from about 1 to about 20 weight % of the total dry layer weight.

9. The element of claim 1 wherein the cellulosic raw base support comprises an electrolyte in an amount of up to 0.5 weight % based on total dry base support weight.

10. The element of claim 1 wherein the cellulosic raw base support comprises an electrolyte in an amount of from about 0.01 to about 4 weight % based on total dry base support weight.

11. The element of claim 1 further comprising a compliant layer between the cellulosic raw base support and the antistatic subbing layer.

12. The element of claim 11 wherein the compliant layer is a voided compliant layer.

13. The element of claim 1 wherein the cellulosic raw base support has a dry thickness of from about 10 to about 1000 μm, the antistatic subbing layer has a dry thickness of from about 0.01 to about 2 μm, and the thermal dye receiving layer has a dry thickness of from about 0.5 to about 20 μm.

14. The element of claim 1 wherein the antistatic subbing layer is an aqueous-coated layer.

15. The element of claim 1 wherein the thermal dye receiving layer also comprises an antistatic agent distributed within a polymer binder.

16. An assembly comprising the thermal dye image receiver element of claim 1 and a thermal dye donor element.

17. The assembly of claim 16 wherein the internal electrical resistance (WER) of the cellulosic raw base support is at least 1.5 log ohm/square greater than the surface electrical resistance (SER) of the antistatic subbing layer, and the antistatic subbing layer comprises tin oxide in an amount of from about 1 to about 70 weight % based on dry subbing layer weight, and the cellulosic raw base support comprises an electrolyte in an amount of up to 0.5 weight % based on total dry base support weight.

18. The assembly of claim 16 wherein the internal electrical resistance (WER) of the cellulosic raw base support is at least 1.5 log ohm/square greater than the surface electrical resistance (SER) of the antistatic subbing layer, and the antistatic subbing layer comprises 3,4-dialkoxy substituted polythiophene styrene sulfonate in an amount of from about 1 to about 20 weight % based on dry subbing layer weight, and the cellulosic raw base support comprises an electrolyte in an amount from about 0.01 to about 0.4 weight % based on total dry base support weight.

* * * * *